US005123353A

United States Patent [19]

Beck

[11] Patent Number: 5,123,353

[45] Date of Patent: Jun. 23, 1992

[54] PLATE LOCK-UP APPARATUS

[75] Inventor: John T. Beck, Elmhurst, Ill.

[73] Assignee: Rockwell International Corporation, El Segundo, Calif.

[21] Appl. No.: 725,129

[22] Filed: Jul. 3, 1991

[51] Int. Cl.[5] ..... B41F 1/28; B41F 21/00

[52] U.S. Cl. ..... 101/415.1; 292/257

[58] Field of Search ..... 61/415.1, 378, 409; 292/257

[56] References Cited

U.S. PATENT DOCUMENTS

| | | | |
|---|---|---|---|
| 3,626,848 | 12/1971 | Tafel et al. | 101/415.1 |
| 3,727,551 | 4/1973 | Kostas et al. | 101/415.1 |
| 3,757,691 | 9/1973 | Etchell et al. | 101/378 X |
| 3,913,480 | 10/1975 | Dauner et al. | 101/378 X |
| 4,495,865 | 1/1985 | Kamoda | 101/415.1 |

*Primary Examiner*—Edgar S. Burr
*Assistant Examiner*—Moshe I. Cohen
*Attorney, Agent, or Firm*—C. B. Patti; V. L. Sewell; H. F. Hamann

[57] ABSTRACT

A lock-up mechanism for use in securing a flexible printing plate 14 in a printing press, the flexible printing plate 14 having a leading edge 14 and a trailing edge 16. The lock-up mechanism has a plate cylinder 10 having a longitudinal groove 20 in an outer surface thereof and a lock-up body 22 contained in the longitudinal groove 20 of the plate cylinder 10. The lock-up body 22 has a longitudinal slot 24 having a narrow opening 26 formed by opposed nose sections 28, 30 of the lock-up body 22, the nose sections each having an inner surface, 36, 38. A rotatable mechanism 40 in the longitudinal slot 24 releasably secures the leading and trailing edges 16, 18 of the flexible printing plate 14, the flexible printing plate 14 being wrapped around the outer surface of the plate cylinder 10. A first apparatus 48, 51, 55, 36 provides at least one predetermined lock position of the rotatable mechanism 40 wherein the leading and trailing edges 16, 18 of the flexible printing plate 10 are secured. A second apparatus 48, 52, 53, 36 provides at least one predetermined unlock position of the rotatable mechanism 40 wherein the leading and trailing edges 16, 18 of the flexible printing plate 10 are unsecured. The rotatable mechanism 40 has at least one lock holding structure 48, 51 within the longitudinal slot 24 for holding the rotatable mechanism 40 in the at least one predetermined lock position and at least one unlock holding structure 48, 52 within the longitudinal slot 24 for holding the rotatable mechanism 40 in the predetermined unlock position. The rotatable mechanism 40 is rotatable between the predetermined lock position and the predetermined unlock position.

9 Claims, 4 Drawing Sheets

PLATE LOCK-UP APPARATUS

BACKGROUND OF THE INVENTION

The present invention relates in general to a lock-up mechanism for mounting a flexible printing plate on a plate cylinder of a printing press.

In printing presses such as a conventional web fed rotary printing press, a printing plate is wrapped about a plate cylinder and is mounted under tension on the plate cylinder by clamping the opposite ends of the printing plate between inner walls of an axial slot formed on the periphery of the plate cylinder and a plate clamping shaft disposed in the slot. The plate clamping shaft is then rotated. After clamping, the printing plate should be uniformally tensioned in all directions, and the clamp is secured in place during printing to prevent movement of the printing plate and resulting registration errors.

In a conventional plate clamping device of this type, an eccentric plate clamping shaft is journaled by bearers at both longitudinal ends of the plate cylinders, and the opposite ends of the printing plate are inserted into gaps between the plate clamping shaft and the inner walls of the slot. As a result, the printing plate is clamped by the wedge action of the plate clamping shaft caused by the tension of the printing plate. As a consequence, the long plate clamping shaft journaled at its opposite ends has a tendency to be bent by the tension of the printing plate so that the printing plate is not under uniform tension.

In printing presses such as offset lithographic printing presses the use of thin, flexible plates is typical and are basically planographic, that is, without relief, and are treated so that the surfaces have areas which attract or repel oil and water to create areas of image differentiation. To mount such plates on the surface of the press cylinder, it is essential to insure that the plate conforms closely to the outer surface of the plate cylinder. Mounting is usually effected by forming a longitudinal slot in the plate cylinder and inserting thereinto one of a variety of biasing or clamping devices called lock-ups. Often the trailing edge of the plate is bent back on itself so that the bent portion can fit over the edge formed in the cylinder by the longitudinal slot and then be held in position by some form of spring or clamp. Alternatively, mechanisms have been provided in which the plate leading edge is rigidly clamped.

In other prior art devices, the plate leading edge is held between two parts which are of an approximately trapezoidal shape. The two trapezoidally shaped parts are forced inwardly to clamp the end of the plate within a slot. The trailing edge of the plate is held between a sloped surface of one of the trapezoidal parts and a similarly sloped wall of the slot in the plate cylinder. Numerous other types of lock-up devices are known in the prior art.

Disadvantages of the prior art is that many of the lock-up devices require mechanisms external to their ends and the plate cylinder for securing the lock-up device in position. Also, many lock-up devices are known to loosen during operation of the printing press because they do not have a set position for locking the leading and trailing edges of the printing plate.

SUMMARY OF THE INVENTION

It is an object of the present invention to provide an improved lock-up mechanism for securing a flexible printing plate to an outer surface of a plate cylinder in a printing press.

It is a further object of the present invention to provide an improved lock-up mechanism in which both the leading and trailing edges of the printing plate are held securely in position during operation.

It is a further object of the present invention to provide an improved lock-up mechanism which is internal to the plate cylinder, that is, does not utilize mechanisms external to the ends of the plate cylinder.

These objects are achieved by a lock-up mechanism of the present invention which secures the flexible printing plate to the outer surface of the plate cylinder, the flexible printing plate having a leading edge and a trailing edge. The lock-up mechanism consists of a longitudinal slot in the outer surface of the plate cylinder, and a rotatable means contained in the longitudinal slot having at least one predetermined lock position and at least one predetermined unlocked position. The rotatable means has means for securing the leading and trailing edges of the flexible printing plate in the predetermined lock position and means for releasing the leading and trailing edges of the flexible printing plate in the predetermined unlocked position. The rotatable means also has at least one lock holding means within the longitudinal slot for holding the rotatable means in the at least one predetermined lock position and at least one unlock holding means within the longitudinal slot for holding the rotatable means in the predetermined unlock position. The rotatable means is rotated between the lock position and the unlock position.

In one embodiment, the rotatable means rotates about a center pivot location of the rotatable means. In another embodiment the rotatable means has first and second opposed predetermined lock positions each having an associated lock holding means and an unlock position intermediate the first and second opposed predetermined lock positions. This embodiment permits the flexible printing plate to be wrapped around the plate cylinder in either direction.

In a further embodiment of the present invention the plate cylinder has a longitudinal groove in the outer surface thereof and a lock up body is provided and contained in the longitudinal groove of the plate cylinder. The lock-up body then has the longitudinal slot which has a narrow opening formed by opposed nose sections of the lock-up body. The rotatable means is then contained in the longitudinal slot of the lock-up body.

A tension means is provided in the bottom of the longitudinal slot opposed from the narrow opening of the longitudinal slot and forces the rotatable means upwards against inner surfaces of the nose sections. In a preferred embodiment a plurality of spaced tension means are provided along the bottom of the longitudinal slot.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures in which like reference numerals identify like elements, and in which:

DESCRIPTION OF THE PREFERRED EMBODIMENT

The present invention has general applicability and is depicted in two embodiments in FIGS. 1–4 and 5, 6 of the drawings.

Each of the two embodiments of the present invention has common advantageous, such as, predetermined set lock and unlock positions so that the flexible printing plate wrapped around the plate cylinder is held firmly in place during operation of the printing press. Each of the embodiments of the lock-up mechanism is also completely contained within a longitudinal slot either in a separate body of the lock-up mechanism or directly in a longitudinal groove of the plate cylinder. Also, each of the embodiments provides a means for securing the leading and trailing edges of the flexible printing plate in the predetermined lock position and means for releasing the leading and trailing edges of the flexible printing plate in the unlock position. Also, the lock-up mechanism provides at least one lock holding means within the longitudinal slot for holding the rotatable means in the lock position and at least one unlock holding means within the longitudinal slot for holding the rotatable mean in the predetermined unlock position. In each of the embodiments, the rotatable means is rotated between the lock position and the unlock position substantially about a center pivot.

Figure 1:
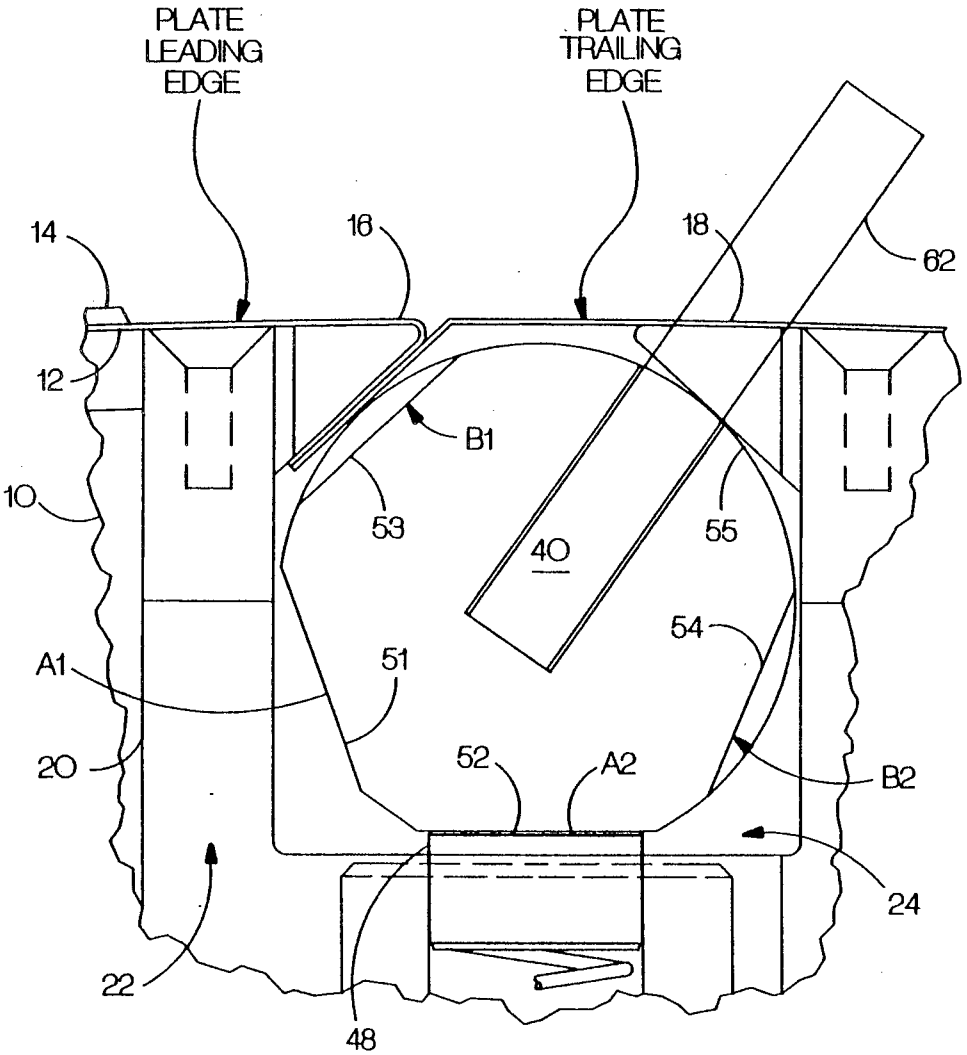
FIG. 1 is a cross-sectional view of one embodiment of the lock-up mechanism of the present invention having at least two flat areas on the rotatable means for defining a lock and unlock position.
Figure 3:
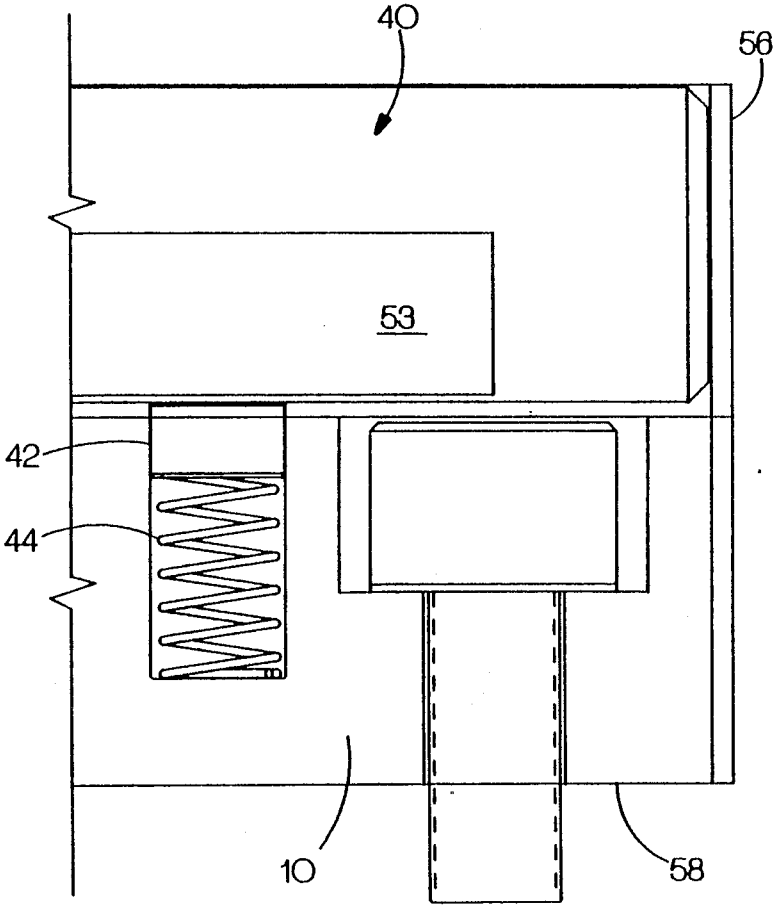
FIG. 3 is a cross-sectional side view of the FIG. 1 embodiment.
Figure 2:
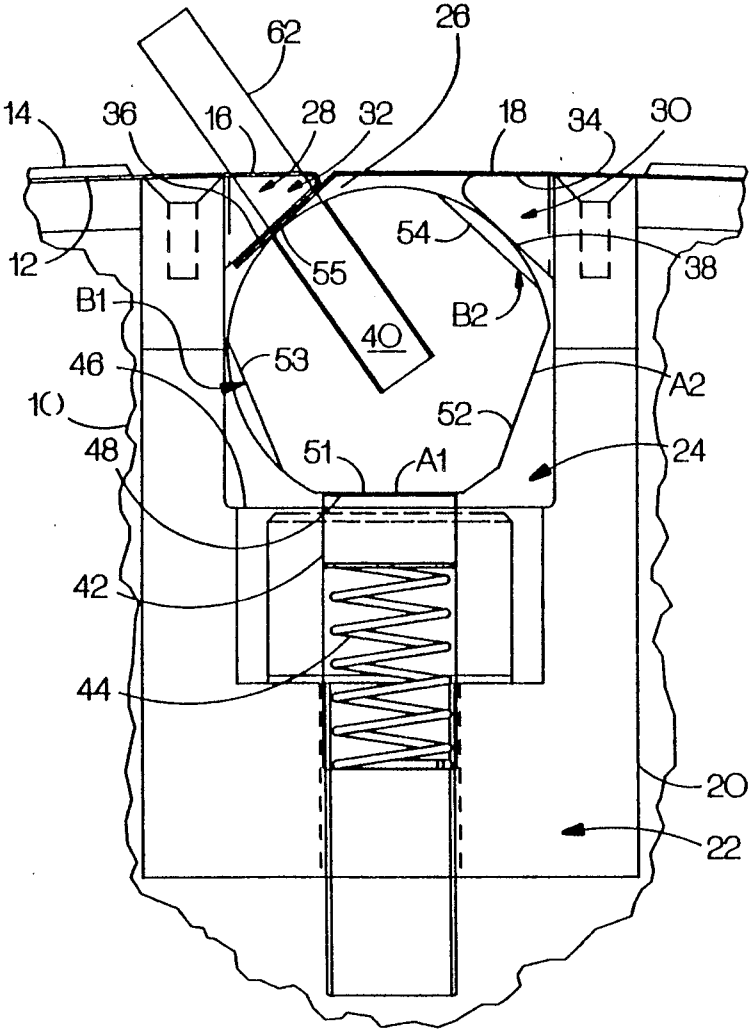
FIG. 2 is a cross-section of the FIG. 1 embodiment depicting the lock-up mechanism in the lock position.

FIG. 1 depicts one embodiment of the lock-up mechanism of the present invention in an unlock position and FIG. 2 depicts this embodiment in a lock position. FIG. 3 is a side view of one end of the lock-up mechanism contained in a plate cylinder. As depicted in FIGS. 1 and 2 the plate cylinder 10 has an outer surface 12 on which the flexible printing plate 14 is wrapped. The flexible printing plate 14 has a leading edge 16 and a trailing edge 18. The plate cylinder 10 may also have a cushioned outer surface as is well known in the art.

The plate cylinder 10 has a longitudinal groove 20 formed in the outer surface 12 thereof and into which is placed a lock-up body 22. The lock-up body 22 has a longitudinal slot 24 which has a narrow opening 26 formed by opposed nose sections 28, 30 of the lock-up body 22. Each of the nose sections 28, 30 has an outer surface 32, 34 which aligns substantially with the outer surface 12 of the plate cylinder 10 and sloped inner surfaces 36, 38. A rotatable means 40 is positioned in the longitudinal slot 24 for releasably securing the leading and trailing edges 16, 18 of the flexible printing plate 14. In the FIG. 1 embodiment the rotatable means 40 is a cylindrical rod substantially extending the length of the longitudinal slot 24.

A plurality of spaced tension means formed by lifters 42 and springs 44 are provided along a bottom 46 of the longitudinal slot 24. The lifter 42 has a flat upper surface 48 for engaging the cylindrical rod 40 and holding the cylindrical rod 40 against at least one of the inner surfaces 36, 38 of the opposed nose sections 28, 30.

The cylindrical rod 40 has first, second, third and fourth flat areas 51, 52, 53 and 54. In the unlock position depicted in FIG. 1, second flat area 52 engages the upper flat surface 48 of the lifter 42 and a curved portion 55 of the cylindrical rod 40 engages the inner surface 38 of the nose section 30. The third flat area provides a space between the cylindrical rod 40 and the inner surface 36 of the nose section 28 thereby allowing insertion or removal of the leading and trailing edges 16, 18 of the printing plate 14. When the cylindrical rod 40 is rotated to the lock position depicted in FIG. 2, the first flat area 51 engages the flat upper surface 48 of the lifter 42 and the curved portion 55 of the cylindrical rod 40 secures the leading and trailing edges 16, 18 of the printing plate 14 between the inner surface 36 of the nose section 28 and the curved portion 55 of the cylindrical rod 40. The cylindrical rod 40 is held in position during operation of the printing press due to the first flat area 51 engaging the upper flat area 48 of the lifter 42. Thus, the lock-up mechanism of the present invention provides for a predetermined lock position and a predetermined unlocked position.

The fourth flat area 54 is provided on the cylindrical rod 40 so that the printing plate 14 can be wrapped about the printing cylinder 10 in an opposite direction and thereby allow the leading and trailing edges 16, 18 to be inserted into the space formed by the fourth flat area 54 and the inner surface 38 of the nose section 30 depicted in FIG. 2. FIG. 2 then defines an unlock position. By rotation of the cylindrical rod 40 to the position shown in FIG. 1, the leading and trailing edges 16, 18 are then secured between the curved portion 55 and the inner surface 38 of the nose section 30 and therefore define a look position. Thus, it is an advantage of the present invention that the lock-up mechanism without modification can be utilized for wrapping the printing plate in either direction about the plate cylinder.

Figure 4:
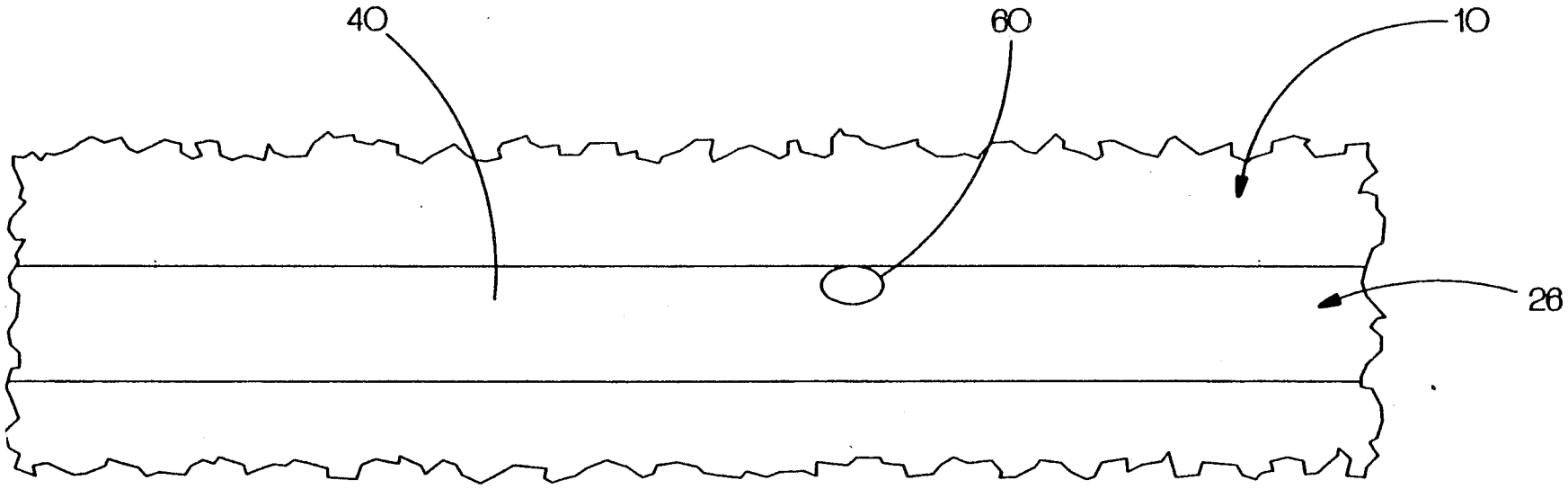
FIG. 4 is a partial top view of the plate cylinder and the lock-up mechanism contained in a longitudinal groove of the plate cylinder.

FIG. 3 depicts a side view of the lock-up mechanism depicted in FIGS. 1 and 2. An end retaining plate 56 is provided and attached to the end 58 of the printing cylinder 10 to hold the cylindrical rod 40 in position. FIG. 4 shows a partial top view of the printing cylinder 10 containing the lock-up mechanism of the present invention. A hole 60 is provided in the cylindrical rod 40 of the lock-up mechanism into which a tool 42 (see FIGS. 1 and 2) is inserted for rotating the cylindrical rod 40 between the lock and unlock positions. Numerous other configurations and devices can be utilized by one skilled in the art for changing the position of the cylindrical rod 40 between the lock and unlock positions.

Figure 5:
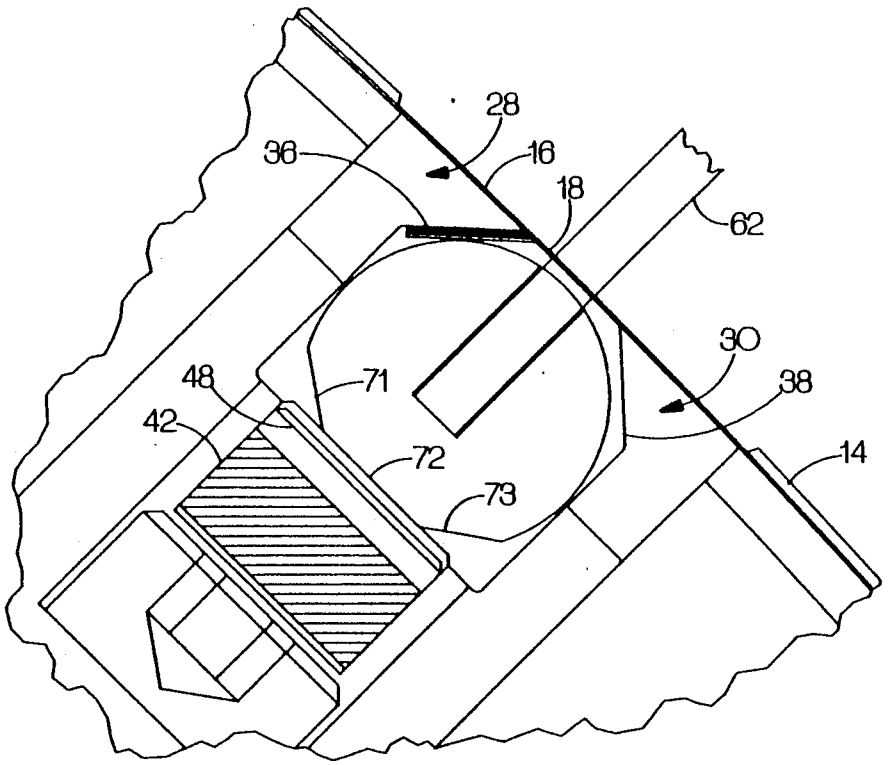
FIG. 5 is a cross-sectional view of a preferred embodiment of the lock-up mechanism of the present invention in which a flat area defines an unlock position and is intermediate of two opposed flat areas which define two lock positions.
Figure 6:
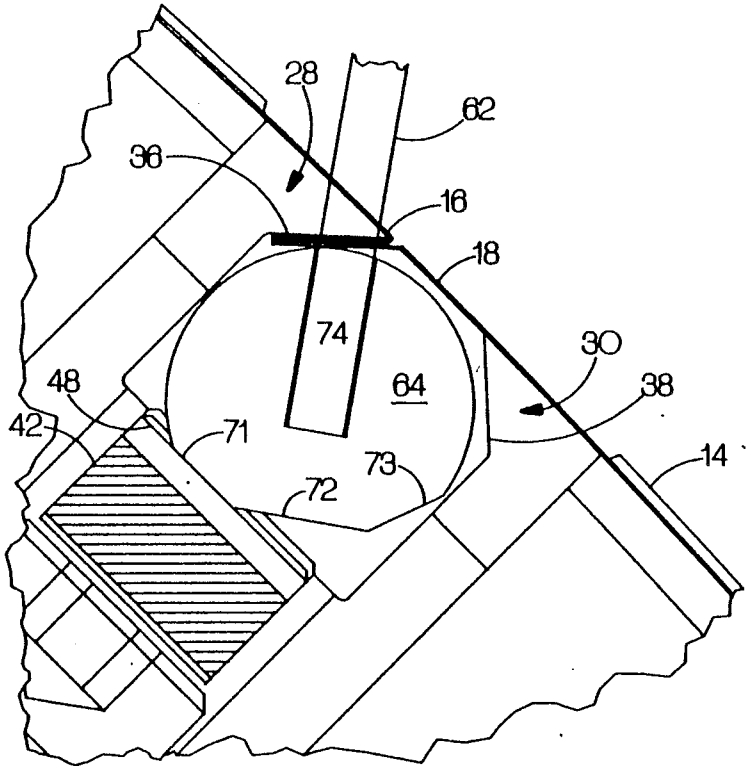
FIG. 6 is a cross-sectional view of the FIG. 5 embodiment shown in a lock position.

FIGS. 5 and 6 depict a preferred embodiment of the present invention in which FIG. 6 depicts a lock position and FIG. 5 depicts an unlock position. Again, the lock and unlock positions can be reversed depending upon the direction which the printing plate 14 is wrapped about the outer surface 12 of the plate cylinder 10. As shown, for example, in FIG. 6 of the lock position, the rotatable means is a cylindrical rod 64 which has first, second and third flat areas 71, 72 and 73. The lock position is defined when the first flat area 71 engages the flat upper surface 48 of the lifter 42. A curved portion 74 of the cylindrical rod 64 then secures the leading and trailing edges 16, 18 of the printing plate 14 between the curved portion 74 and the inner surface 36 of the nose section 28.

In the unlocked position depicted in FIG. 5 the second flat area 72 engages the flat upper surface 48 of a lifter 42, the lifter 42 being at a full extent. Since the second flat area 72 is more extensive than the first flat area 71, the cylindrical rod 64 is not forced against the inner surface 36 of the nose section 28. This allows the leading and trailing edges 16, 18 of the printing plate 14 to be inserted or removed from the lock-up mechanism. As can be seen from FIGS. 5 and 6, a third flat area 73 is provided which defines a lock position when the cylindrical rod 64 is rotated in a clockwise direction from the position depicted in FIG. 5 and when the leading and trailing edges 16, 18 of the printing plate 14 are inserted in the space adjacent the inner surface 38 of the nose section 30, corresponding to wrapping the printing plate 14 about the plate cylinder 10 in the opposite direction than is depicted in FIGS. 5 and 6. Thus again, without any modifications, the embodiment depicted in FIGS. 5 and 6 of the lock-up mechanism of the present invention provide for wrapping the printing plate 14 in either direction about the plate cylinder 10.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. A lock-up mechanism for use in securing a flexible printing plate in a printing press, the flexible printing plate having a leading edge and a trailing edge, comprising:

a plate cylinder having a longitudinal groove in an outer surface thereof;

a lock-up body contained in said longitudinal groove of said plate cylinder, said lock-up body having a longitudinal slot having a narrow opening formed by opposed nose sections of the lock-up body, said nose sections each having an inner surface;

rotatable means in said longitudinal slot for releasably securing the leading and trailing edges of the flexible printing plate, said flexible printing plate being wrapped around said outer surface of said plate cylinder, said rotatable means being a cylindrical rod substantially extending the length of said longitudinal slot;

first means for providing at least one predetermined lock position of said rotatable means wherein the leading and trailing edges of said flexible printing plate are secured;

second means for providing at least one predetermined unlock position of said rotatable means wherein the leading and trailing edges of said flexible printing plate are unsecured;

said rotatable means having at least one lock holding means within said longitudinal slot for holding a said rotatable means in said at least one predetermined lock position and at least one unlock holding means within said longitudinal slot for holding said rotatable means in said predetermined unlock position;

said lock holding means further comprising at least one tension means in a bottom of said longitudinal slot opposed from said narrow opening, said tension means having a flat upper surface engaging said cylindrical rod and holding said cylindrical rod against at least one of said inner surfaces of said opposed nose sections;

said cylindrical rod having first, second, third and fourth flat areas such that, when one of said first and second flat areas engages said flat upper surface of said at least one tension means, one of said third and fourth flat areas is adjacent one of said inner surfaces of said nose sections thereby defining said predetermined unlock position, and when the other of said first and second flat areas is adjacent said flat upper surface of said tension means, the other of said third and fourth flat areas is adjacent the other of said inner surfaces of said nose sections thereby defining said predetermined lock position; and the leading and trailing edges positioned between said one of said third and fourth flat areas and said one of said inner surfaces of said nose sections in said unlock position and between said one of said inner surfaces of said nose sections and a curved portion of said cylindrical rod in a lock position;

wherein said rotatable means is rotatable between said predetermined lock position and said predetermined unlock position.

2. A lock-up mechanism according to claim 1, wherein a plurality of spaced tension means are provided along said bottom of said longitudinal slot.

3. A lock-up mechanism according to claim 1, wherein said at least one tension means is a lifter having said flat upper surface on a first end thereof and a spring means on a second end thereof for pressing said flat upper surface against said cylindrical rod.

4. A lock-up mechanism for use in securing a flexible printing plate in a printing press, the flexible printing plate having a leading edge and a trailing edge, comprising:

a plate cylinder having a longitudinal groove in an outer surface thereof;

a lock-up body contained in said longitudinal groove of said plate cylinder, said lock-up body having a longitudinal slot having a narrow opening formed by opposed nose sections of the lock-up body, said nose sections each having an inner surface;

rotatable means in said longitudinal slot for releasably securing the leading and trailing edges of the flexible printing plate, said flexible printing plate being wrapped around said outer surface of said plate cylinder;

first means for providing at least one predetermined lock position of said rotatable means wherein the leading and trailing edges of said flexible printing plate are secured;

second means for providing at least one predetermined unlock position of said rotatable means wherein the leading and trailing edges of said flexible printing plate are unsecured;

said rotatable means having at least one lock holding means within said longitudinal slot for holding said rotatable means in said at least one predetermined lock position and at least one unlock holding means within said longitudinal slot for holding said rotatable means in said predetermined unlock position;

wherein said rotatable means is rotatable between said predetermined lock position and said predetermined unlock position;

said rotatable means being a cylindrical rod substantially extending the length of said longitudinal slot;

said lock-up mechanism further comprises at least one tension means in a bottom of said longitudinal slot opposed from said narrow opening, said tension means having a flat upper surface engaging said cylindrical rod and holding said cylindrical rod against at least one of inner surfaces of said opposed nose sections;

said cylindrical rod having first, second and third flat areas such that, when one of said first and third flat areas engages said flat upper surface of said tension means, a curved portion of said cylindrical rod is positioned adjacent said inner surfaces of said nose sections thereby defining said predetermined lock position, and when said second flat area on said cylindrical rod engages said flat upper portion of said tension means, said curved portion is spaced away from said inner surfaces of said nose sections thereby defining said predetermined unlock portion, said second flat area located intermediate said first and third flat areas; and in said predetermined lock position said leading and trailing edges of said flexible printing plate being secured between said curved portion of said cylindrical rod and one of said inner surfaces of said nose sections, and in said predetermined unlock position said leading and trailing edges of said flexible printing plate being unsecured between said curved portion of said cylindrical rod and said one of said inner surfaces of said nose sections.

5. A lock-up mechanism according to claim 4, wherein a plurality of tension means are provided along said bottom of said longitudinal slot.

6. A lock-up mechanism according to claim 4, wherein said at least one tension means is a lifter having said flat upper surface on a first end thereof and a spring means on a second end thereof for pressing said flat upper surface against said cylindrical rod.

7. A lock-up mechanism for use in securing a flexible printing plate in a printing press, the flexible printing plate having a leading edge and a trailing edge, comprising:

a plate cylinder having a longitudinal groove in an outer surface thereof;

a lock-up body contained in said longitudinal groove of said plate cylinder, said lock-up body having a longitudinal slot having a narrow opening formed by opposed nose sections of the lock-up body, said nose sections each having an inner surface;

rotatable means in said longitudinal slot for releasably securing the leading and trailing edges of the flexible printing plate, said flexible printing plate being wrapped around said outer surface of said plate cylinder, said rotatable means.being a cylindrical rod substantially extending the length of said longitudinal slot;

at least one tension means in a bottom of said longitudinal slot opposed from said narrow opening, said tension means having a flat upper surface engaging said cylindrical rod and holding said cylindrical rod against at least one of inner surfaces of said opposed nose sections;

first, second and third flat areas on said cylindrical rod such that, when one of said first and third flat areas engages said flat upper surface of said tension means, a curved portion of said cylindrical rod is positioned adjacent said inner surfaces of said nose sections thereby defining a predetermined lock position, and when said second flat area on said cylindrical rod engages said flat upper portion of said tension means, said curved portion is spaced away from said inner surfaces of said nose sections thereby defining a predetermined unlock portion, said second flat area located intermediate said first and third flat areas; and in said predetermined lock position said leading and trailing edges of said flexible printing plate being secured between said curved portion of said cylindrical rod and one of said inner surfaces of said nose sections, and in said predetermined unlock position said leading and trailing edges of said flexible printing plate being unsecured between said curved portion of said cylindrical rod and said one of said inner surfaces of said nose sections;

wherein said rotatable means is rotatable between said predetermined lock position and said predetermined unlock position.

8. A lock-up mechanism according to claim 7, wherein a plurality of spaced tension means are provided along said bottom of said longitudinal slot.

9. A lock-up mechanism according to claim 7, wherein said at least one tension means is a lifter having said flat upper surface on a first end thereof and a spring means on a second end thereof for pressing said flat upper surface against said cylindrical rod.

* * * * *